US005681186A

United States Patent [19]

Wright

[11] Patent Number: 5,681,186

[45] Date of Patent: Oct. 28, 1997

[54] CONNECTOR MODULE, CONNECTOR KIT AND CONNECTOR MODULE AND PANEL ASSEMBLY

[75] Inventor: John O. Wright, York, Pa.

[73] Assignee: Osram Sylvania Inc., Danvers, Mass.

[21] Appl. No.: 611,227

[22] Filed: Mar. 5, 1996

[51] Int. Cl.[6] ..... H01R 17/04

[52] U.S. Cl. ..... 439/675; 439/63; 439/607; 439/561

[58] Field of Search ..... 439/63, 578, 581, 439/675, 733.1, 561, 607

[56] References Cited

U.S. PATENT DOCUMENTS

| | | | |
|---|---|---|---|
| 1,828,276 | 10/1931 | Beers | 439/675 |
| 3,794,962 | 2/1974 | Clark | 439/562 |
| 4,737,111 | 4/1988 | Minar et al. | 439/63 |
| 4,795,352 | 1/1989 | Capp et al. | 439/63 |
| 4,846,719 | 7/1989 | Iwashita | 439/63 |
| 5,147,221 | 9/1992 | Cull et al. | 439/675 |
| 5,154,628 | 10/1992 | Skegin | 439/675 |
| 5,286,218 | 2/1994 | Sakurai et al. | 439/733.1 |
| 5,547,400 | 8/1996 | Wright | 439/63 |
| 5,562,506 | 10/1996 | Wright | 439/675 |
| 5,599,198 | 2/1997 | Wang | 439/944 |

FOREIGN PATENT DOCUMENTS

| | | | |
|---|---|---|---|
| 3712693 | 10/1988 | Germany | 439/578 |

*Primary Examiner*—Neil Abrams
*Assistant Examiner*—Katrina Davis
*Attorney, Agent, or Firm*—William H. McNeill

[57] ABSTRACT

A connector module, connector module kit and connector module and panel assembly are provided. The connector module includes a conductive plate having at least one aperture through which a wall of an insulator extends, the wall defining a cavity. A contact extends through the base of the insulator and into the cavity, the contact being spaced from the wall. The connector module may be easily attached to a panel by using tabs extending from the panel or a C-shaped clip which is attached to the wall.

18 Claims, 3 Drawing Sheets

CONNECTOR MODULE, CONNECTOR KIT AND CONNECTOR MODULE AND PANEL ASSEMBLY

TECHNICAL FIELD

The present invention relates to a connector module, a connector module kit and a connector module and panel assembly. The present invention is particularly useful in providing an antenna connector module for attachment to an automobile panel.

BACKGROUND ART

A typical antenna connector for an antenna cable such as those used in the automobile industry for radios includes a male connector generally in the form of a plug and a female connector generally in the form of a ferrule which forms a socket. In use, the male connector is plugged into the female connector to effect a mechanical and electrical connection between the two. Typically, an antenna cable in the form of a coaxial cable is electrically and mechanically attached to one of the connectors such as the male connector, and the other connector, such as the female connector, is electrically and mechanically attached to a circuit such as a circuit on a printed circuit board. Such prior art devices are typically attached to a panel of an automobile to hold the devices in place. It is known for such devices to inadvertently become loose or disconnected from the panel. In addition, the lack of satisfactory tactile feedback in making the required connections makes it difficult to know when a suitable connection has been made. Attaining satisfactory grounding and undesirable shorting have also been problems.

DISCLOSURE OF THE INVENTION

It is an object of the present invention to provide a connector module which may be readily attached to a panel.

Another object of the present invention is to provide a connector module the use of which reduces the tendency of the connector module to become inadvertently loosened or disconnected from a panel to which it is attached.

It is another object of the present invention to provide a connector which provides tactile feedback when connected to another connector.

A further object of the present invention is to provide a connector module which allows for effecting an improved grounding thereof.

Another object of the present invention is to provide a connector module which allows for effecting an improved connector assembly.

Yet a further object of the present invention is to provide a relatively simple connector module, the components of which may be in kit form.

A further object of the present invention is to provide a connector module the use of which reduces the tendency for the connector to short.

This invention achieves these and other objects by providing a connector module the components of which comprise a conductive plate, an insulator and a pair of contacts. A connector module kit is also provided which includes each of these components. An assembly is also provided comprising such connector module attached to a panel. The connector module comprises a conductive plate comprising a hole having a hole axis. A plurality of flexible arms extend from a periphery of the hole in the direction of the hole axis. An insulator is provided comprising a base, a wall enclosing a cavity and extending from the base in the direction of the hole axis and into the hole. The base comprises a base aperture opening into the cavity. The wall comprises a plurality of openings. A portion of each arm of the plurality of arms extends through a respective opening of the plurality of openings and into the cavity. A contact is provided. The contact extends through the base aperture into the cavity. The contact is spaced from the plurality of arms.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
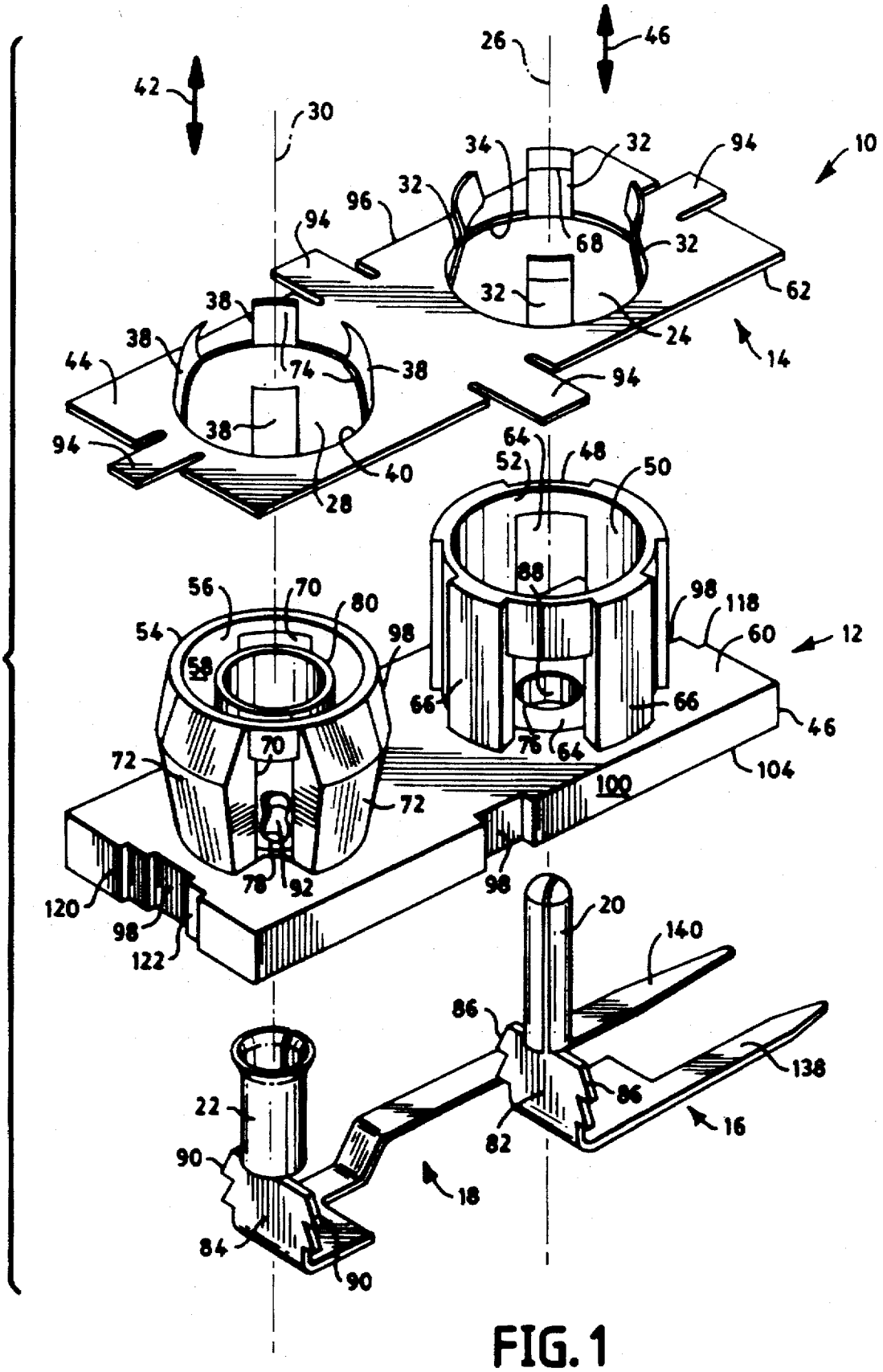
FIG. 1 is an exploded perspective view of one embodiment of the present invention depicting the components of a connector module kit of the present invention and their assembled relationship as a connector module of the present invention.

The embodiment of this invention which is illustrated in FIG. 1 is particularly suited for achieving the objects of this invention. FIG. 1 depicts a connector module 10 the components of which comprise an insulator 12, a conductive plate 14 and a pair of contacts 16 and 18. Such components form the connector module kit of the present invention. In the embodiment of FIG. 1, contacts 16 and 18 are in the form of a male contact having a conventional prong 20 for mating with a female contact in the usual manner and a female contact comprising a ferrule 22 into which a male contact prong may be inserted in the usual manner. It will be readily apparent to those having ordinary skill in the art that both contacts may be male contacts or female contacts, if desired.

The conductive plate 14 comprises a hole 24 having an axis 26 and a hole 28 having an axis 30. Holes 24 and 28 extend completely through the plate 14. A plurality of resilient arms 32 extend from a periphery 34 of the hole 24 in the direction 36 of axis 26. In a like manner, a plurality of resilient arms 38 extend from a periphery 40 of hole 28 in the direction 42 of the axis 30.

Arms 32 and 38 extend away from a surface 44 of plate 14. In the preferred embodiment of FIG. 1 there are four equally spaced arms 32 and four equally spaced arms 38, although more or less of such arms may be provided.

Insulator 12 comprises a base 46. A wall 48 extends from base 46 in the direction 36 of axis 26 and encloses a cavity 50. In the embodiment of FIG. 1, the wall 48 includes a cylindrical inner surface 52. Wall 48 extends into hole 24. Similarly, insulator 12 comprises a wall 54 which extends from base 46 in the direction 42 of axis 30 and encloses a cavity 56. In the embodiment of FIG. 1, the wall 54 includes a cylindrical inner surface 58. Wall 54 extends into hole 28. When the plate 14 and insulator 12 are assembled together by inserting the walls 48 and 54 into respective holes 24 and 28, a surface 60 of the base 46 will engage a surface 62 of the plate 14. Wall 48 comprises a plurality of openings 64 formed by providing by a plurality of circumferentially spaced upstanding leg potions 66 of the wall. A portion of each arm 32 extends through a respective opening 64 into cavity 50. For example, in the embodiment of FIG. 1, each arm 32 comprises a portion 68 which is convex relative to axis 26 and extends through an opening 64 into cavity 50. Wall 54 comprises a plurality of openings 70 provided by a plurality of circumferentially spaced upstanding leg portions 72 of the wall. A portion of each arm 38 extends through a respective opening 70 into cavity 56. For example, in the embodiment of FIG. 1, each arm 38 comprises a potion 74 which is concave relative to axis 30 and extends through an opening 70 into cavity 56. In the preferred embodiment of FIG. 1 there are four equally spaced openings 64 (two are visable in the drawing) and four equally spaced openings 70 (two are shown in the drawing), although more or less of such openings may be provided so long as there is a respective opening for each of the arms 32 and 38 to extend through into a respective cavity 50 and 56. The base 46 comprises apertures 76 and 78 which extend completely through the base and open into a respective cavity 50 and 56.

Contacts 16 and 18 extend through respective apertures 76 and 78 into respective cavities 50 and 56 in such a manner that contact 16 is spaced from the arms 32 of the plate 14 and contact 18 is spaced from the arms 38 of the plate 14. For example, in the embodiment of FIG. 1, the contact 16 is a male contact having a prong 20 which extends axially through aperture 76 into cavity 50. Although arms 32 extend radially through openings 64 into cavity 50, the extent to which the arms enter the cavity is limited so that the prong 20 does not engage any of the arms. Similarly, the contact 18 is a female contact having a ferrule 22 which extends axially through aperture 78 into cavity 56. Although arms 38 extend radially through openings 70 into cavity 56, the extent to which the arms enter the cavity is limited so that the ferrule 22 does not engage any of the arms. If desired, the female 22 may be further insulated from the arms 38 as depicted in FIG. 1. In particular, in the embodiment of FIG. 1 insulator 12 comprises a sleeve 80 positioned within cavity 56. Sleeve 80 extends away from surface 60 of base 46 in the direction 42 of axis 30. Sleeve 80 is spaced from the wall 54. The aperture 78 opens into cavity 56 by opening into the sleeve 80. In the embodiment of FIG. 1 the female ferrule 22 extends through aperture 78 and into the sleeve 80 which serves to shield the ferrule from the conductive arms 38. In the preferred embodiment, insulator 12 is formed from a plastic material which may be molded as a single piece.

In order to hold the contacts 16 and 18 in place relative to the insulator 12, each contact may comprise a base portion which may be press fit into a respective aperture 76, 78. For example, in the embodiment of FIG. 1, contact 16 comprises a compliant base portion 82 which may be press fit into aperture 76, and contact 18 comprises a compliant base portion 84 which may be press fit into aperture 78. Base 82 may further comprise a plurality of pointed projections 86 which engage an inner surface 88 of the aperture 76. Similarly, base 84 may further comprise a plurality of pointed projections 90 which engage an inner surface 92 of the aperture 78.

Figure 2:
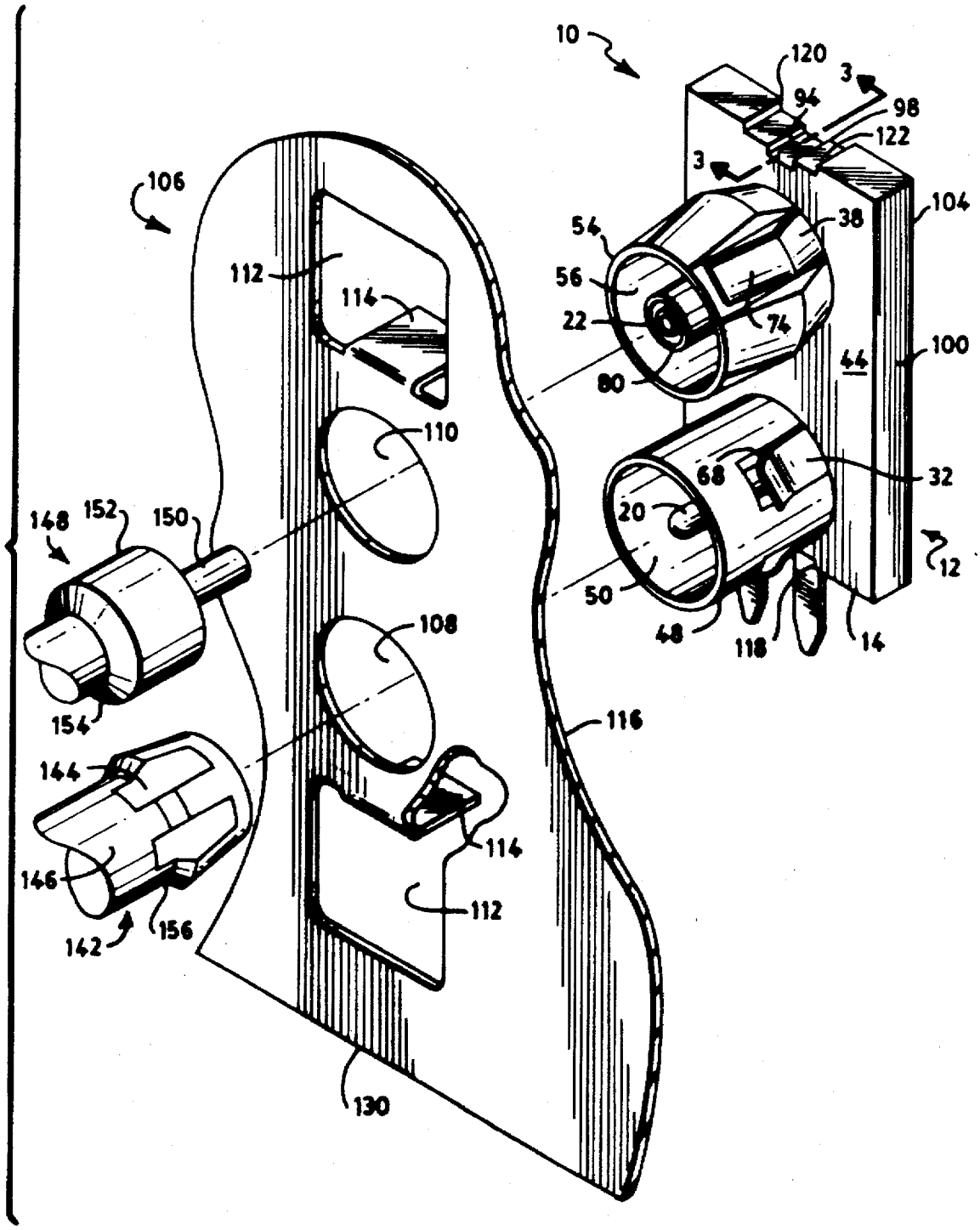
FIG. 2 is an exploded perspective view of a connector module and panel assembly of the present invention.
Figure 3:
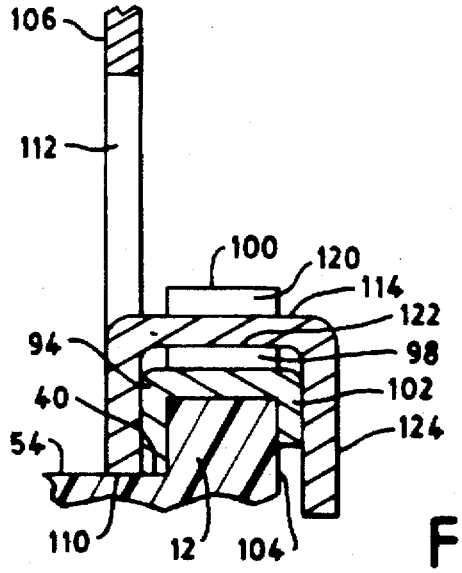
FIG. 3 is a view of FIG. 2 taken along lines 3—3.

In the preferred embodiment the conductive plate 14 is attached to the insulator 12. For example, in the embodiment of FIG. 1 plate 14 comprises a plurality of tabs 94 which extend from a periphery 96 of the plate. There are four tabs 94 although more or less of such tabs may be provided. Insulator 12 comprises a plurality of grooves 98 each of which extends into a periphery 100 of the insulator. There are four grooves 98 although more or less grooves may be provided so long as there is a respective groove for each tab 94. When the walls 48 and 54 have been inserted into respective holes 24 and 28 to the extent that surface 60 of insulator 12 engages surface 62 of plate 14, each tab 94 will be aligned with a respective groove 98. The insulator 12 and plate 14 may then be attached to each other by merely bending each tab 94 into a groove 98 and then bending a distal end 102 of each tab against the surface 104 of the insulator as depicted in FIGS. 2 and 3 to be explained further hereinafter.

In the preferred embodiment the connector module is fabricated for attachment to a panel to provide a connector and panel assembly of the present invention. For example, FIG. 2 depicts the connector module 10 of FIG. 1 for attachment to a panel such as, for example, an automobile panel 106. Panel 106 comprises an orifice 108 and an orifice 110 which extend completely through the panel. Additional orifices 112 are provided in panel 106 to facilitate providing tabs 114 which extend away from a surface 116 of the panel. The connector and panel assembly is formed by inserting the wall 48 into the orifice 108 and inserting the wall 54 into orifice 110 until surface 44 of the conductive plate 14 engages surface 116 of the panel 106.

In the preferred embodiment the connector 10 is attached to the panel 106 by providing a groove 118 and a groove 120 which extend into the periphery 100 of the insulator 12. Grooves 118 and 120 each comprises a groove base 122 into which a respective groove 98 extends. Although only groove 120 can be seen in its entirety in the drawings, the groove 118 is identical to groove 120. In assembling the connector and panel assembly depicted in FIG. 2, the connector 10 is first assembled as described above. Then the walls 48 and 54 are inserted into orifices 108 and 110, respectively, until the surface 44 of the plate 14 engages the surface 116 of the panel 106. When the walls 48 and 54 have been inserted into the orifices 108 and 110 in this manner, each tab 114 will be aligned with and extend into a respective groove 118 and 120. The connector 10 and panel 106 may then be attached to each other by merely bending a distal end 124 of each tab 114 against the distal end 102 of a tab 94 which extends in one of the grooves 98 which are provided in a base 122 of a respective groove 118 and 120, as depicted in FIGS. 2 and 3.

In use, the contacts 16 and 18 are provided with legs 138 and 140, respectively, which will be mechanically and electrically connected to circuitry in a conventional manner, and the connector module I0 and panel 106 will be assembled as described herein.

Figure 4:
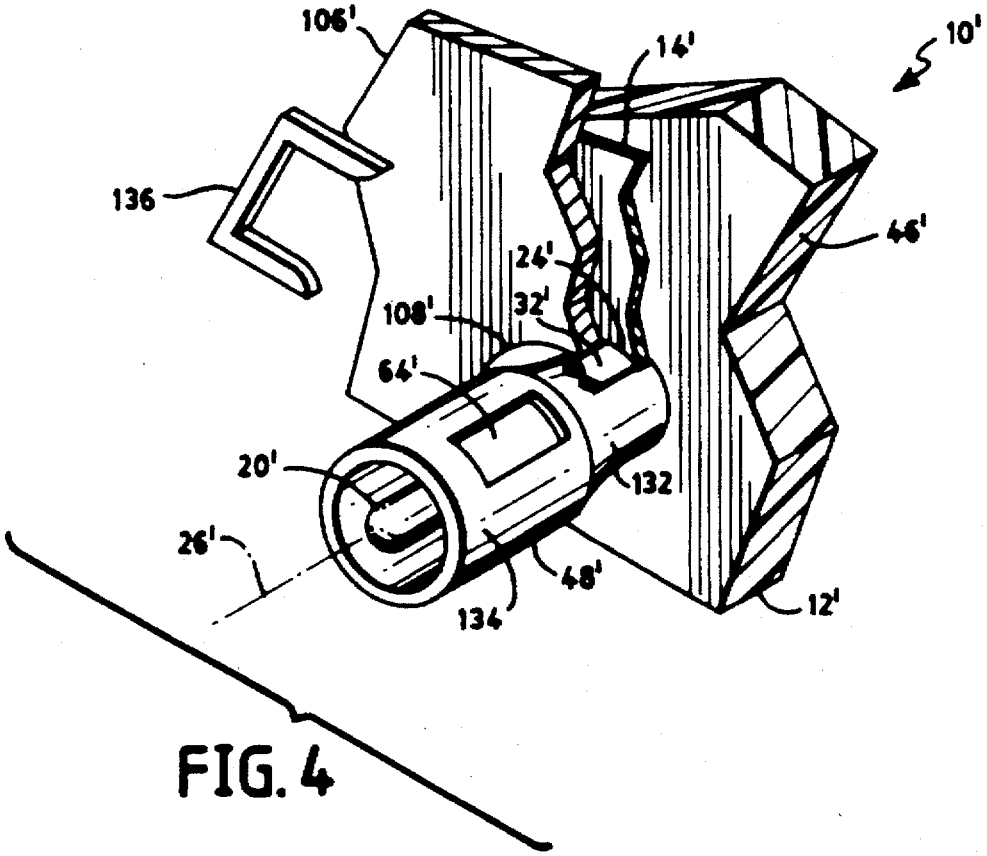
FIG. 4 is an exploded perspective view of an alternative embodiment Of the present invention.

If it is desired to locate the connector module 10 closer to the bottom 130 of the panel 106, the alternative embodiment depicted in FIG. 4 may be used. FIG. 4 has been dram as a diagrammatic representation in order to clarify the particular aspects of the alternative embodiment, it being understood that the components depicted therein are the same, and have been referenced with identical primed reference numerals, as corresponding components of FIG. 1, except as otherwise noted. In FIG. 4, a connector module 10' is depicted having an insulator 12' similar to insulator 12 with the exception that insulator 12' does not require grooves 118 and 120. Rather, at least one of the walls of insulator 12' corresponding to walls 48 and 54 of the insulator 12 of FIG. 1 is provided with a groove into which a C-shaped clip is inserted to-fasten the connector to the panel. For example, in the embodiment of FIG. 4 a wall 48' corresponding to wall 48 of FIG. 1, is provided with a groove 132 which protrudes into an outer surface 134 of the wall 48' adjacent base 46' of the insulator 12'. Groove 132 extends in a circumferential direction relative to the axis 26' of the hole 24' in plate 14'.

In this embodiment, after the wall 48' has been inserted into the orifice 108' of the panel 106', a C-shaped clip 136 is force fit into groove 132 to attach the connector module 10' to the panel 106'. Panel 106' does not require openings 112 or tabs 114. It will be apparent to one having ordinary skill in the art that a groove 132 may also be provided in a wall 54' (not shown) which corresponds to wall 54, an additional C-shaped clip 136 being inserted into such groove to enhance attachment of connector module 10' to panel 106'.

In considering the embodiment of FIG. 1, a conventional female connector 142 comprising a ferrule (not shown) housed within insulative bushing 144 which is housed within a conductive metal shell 146 may be inserted into cavity 50 such that the male prong 20 enters the ferrule and the outer surface of the conductive shell is engaged by the convex portions 68 of the arms 32 of the conductive plate 14. Similarly, a conventional male connector 148 comprising a male prong 150 extending from a contact (not shown) housed within an insulative bushing (not shown) which is housed within a conductive metal shell 152 may be inserted into cavity 56 such that the male prong enters the sleeve 80 and the ferrule 22, and the outer surface of the conductive shell is engaged by the concave potions 74 of the arms 38 of the conductive plate 14.

In the preferred embodiment, the arms 32 and 38 and the respective conductive shells 146 and 152 are dimensioned such that when the male prong 150 is fully inserted into the ferrule 22 and the male prong 20 is fully inserted into the ferrule housed within insulative bushing 144, the installer will experience tactile feedback as the resilient arms 38 and 32 snap into position at recessed portions 154 and 156 of respective conductive shells 152 and 146.

The embodiment described herein is directed to a connector module having two contacts 16 and 18. However, it will be readily apparent to those having ordinary skill in the art that if desired one of such contacts, and the corresponding wall 48 or 54 and the corresponding plurality of arms 32 or 38, may be eliminated, in which case a connector module will be provided for mounting to a panel, such connector module providing a single contact for use with a mating contact as described herein.

Fabrication of the various components described herein may be accomplished using conventional procedures. For example, the insulator may be molded from a plastic material. The conductive members including male and female contacts, panel and conductive plate may be stamped from a metal sheet and then rolled and/or bent if required to form the desired configuration.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention as defined by the appended claims.

What is claimed is:

1. A connector module comprising:

a conductive plate comprising a first hole having a first hole axis and a second hole having a second hole axis, a plurality of flexible first arms extending from a periphery of said first hole in the direction of said first hole axis and a plurality of flexible second arms extending from a periphery of said second hole in the direction of said second hole axis;

an insulator comprising a base, a first wall enclosing a first cavity and extending from said base in said direction of said first hole axis and into said first hole, and a second wall enclosing a second cavity and extending from said base in said direction of said second hole axis, and into said second hole, said base comprising a first base aperture opening into said first cavity and a second base aperture opening into said second cavity, said first wall comprising a plurality of first openings and said second wall comprising a plurality of second openings, a portion of each first arm of said plurality of first arms extending through a respective first opening of said plurality of first openings and into said first cavity, and a portion of each second arm of said plurality of second arms extending through a respective second opening of said plurality of second openings and into said second cavity; and a first contact and a second contact, said first contact extending through said first base aperture into said first cavity and said second contact extending through said second base aperture into said second cavity, said first contact being spaced from said plurality of first arms and said second contact being spaced from said plurality of second arms.

2. The connector module of claim 1 wherein said portion of each first arm is convex relative to said first axis and said portion of each second arm is concave relative to said second axis.

3. The connector module of claim 1 wherein said insulator further comprises a sleeve positioned within said second cavity and extending in the direction of said second hole axis, said sleeve being spaced from said second wall, and said second base aperture opening into said sleeve.

4. The connector module of claim 1 wherein said first contact comprises a first base portion which is press fit into said first base aperture, and said second contact comprises a second base portion which is press fit into said second base aperture.

5. The connector module of claim 1 wherein at least said first wall comprises a first groove which protrudes into an outer surface of said first wall adjacent said base and extends in a circumferential direction relative to said first hole axis.

6. The connector module of claim 1 wherein said conductive plate comprises a plurality of first tabs extending from a periphery of said conductive plate, and further wherein said insulator comprises a plurality of first grooves each of which extends into a periphery of said insulator, each first tab of said plurality of first tabs being aligned with and bent into a respective first groove of said plurality of first grooves.

7. The connector module of claim 6 wherein said insulator further comprises a second groove and a third groove each of which extends into a periphery of said insulator and comprises a respective groove base, one first groove of said plurality of first grooves extending into a groove base of said second groove and another first groove of said plurality of first grooves extending into a groove base of said third groove.

8. A connector module kit comprising:

a conductive plate comprising a first hole having a first hole axis and a second hole having a second hole axis, a plurality of first arms extending from a periphery of said first hole in the direction of said first hole axis and a plurality of second arms extending from a periphery of said second hole in the direction of said second hole axis;

an insulator comprising a base, a first wall enclosing a first cavity and extending from said base and adapted for insertion into said first hole, and a second wall enclosing a second cavity and extending from said base and adapted for insertion into said second hole, said base comprising a first base aperture opening into said first cavity and a second base aperture opening into said second cavity, said first wall comprising a plurality of first openings and said second wall comprising a plurality of second openings, a portion of each first arm of said plurality of first arms being adapted to extend through a respective first opening of said plurality of first openings and into said first cavity, and a portion of each second arm of said plurality of second arms being adapted to extend through a respective second opening of said plurality of second openings and into said second cavity; and a first contact and a second contact, said first contact being adapted to extend through said first base aperture into said first cavity in a spaced relationship relative to said plurality of first arms, and said second contact being adapted to extend through said second base aperture into said second cavity in a spaced relationship relative to said plurality of second arms.

9. The connector module kit of claim 8 wherein said portion of each first arm is convex relative to said first axis and said portion of each second arm is concave relative to said second axis.

10. The connector module kit of claim 8 wherein said insulator further comprises a sleeve positioned within said second cavity and extending away from said base, said sleeve being spaced from said second wall, and said second base aperture opening into said sleeve.

11. The connector module kit of claim 8 wherein said first contact comprises a first base portion adapted to be press fit into said first base aperture, and said second contact comprises a second base portion adapted to be press fit into said second base aperture.

12. The connector module kit of claim 11 wherein said first base portion and said second base portion each comprise a plurality of pointed projections adapted to engage an inner surface of said first base aperture and said second base aperture, respectively.

13. The connector module kit of claim 8 wherein at least said first wall comprises a first groove which protrudes into an outer surface of said first wall adjacent said base, and further comprising a C-shaped clip adapted to be force fit into said first groove.

14. The connector module kit of claim 8 wherein said conductive plate comprises a plurality of first tabs extending from a periphery of said conductive plate, and further wherein said insulator comprises a plurality of first grooves each of which extends into a periphery of said insulator, each first tab of said plurality of first tabs being adapted to be aligned with and bent into a respective first groove of said plurality of first grooves.

15. The connector module kit of claim 14 wherein said insulator further comprises a second groove and a third groove each of which extends into a periphery of said insulator and comprises a respective groove base, one first groove of said plurality of first grooves extending into a groove base of said second groove and another first groove of said plurality of first grooves extending into a groove base of said third groove.

16. A connector module and panel assembly, comprising:

a conductive plate comprising a first hole having a first hole axis and a second hole having a second hole axis, a plurality of first arms extending from a periphery of said first hole in the direction of said first hole axis and a plurality of second arms extending from a periphery of said second hole in the direction of said second hole axis;

an insulator comprising a base, a first wall enclosing a first cavity and extending from said base in said direction of said first hole axis and into said first hole, and a second wall enclosing a second cavity and extending from said base in said direction of said second hole axis and into said second hole, said base comprising a first base aperture opening into said first cavity and a second base aperture opening into said second cavity, said first wall comprising a plurality of first openings and said second wall comprising a plurality of second openings, a portion of each first arms of said plurality of first arms extending through a respective first opening of said plurality of first openings and into said first cavity, and a portion of each second arm of said plurality of second arms extending through a respective second opening of said plurality of second openings and into said second cavity;

a first contact and a second contact, said first contact extending through said first base aperture into said first cavity and said second contact extending through said second base aperture into said second cavity, said first contact being spaced from said plurality of first arms and said second contact being spaced from said plurality of second arms; and a panel comprising a first orifice and a second orifice, said first wall extending into said first orifice and said second wall extending into said second orifice.

17. The connector module and panel assembly of claim 16 wherein said conductive plate comprises a plurality of first tabs extending from a periphery of said conductive plate, and further wherein said insulator comprises a plurality of first grooves each of which extends into a periphery of said insulator, said panel comprises at least a second tab and a third tab, said insulator further comprising a second groove and a third groove each of which extends into a periphery of said insulator and comprises a respective groove base, one first groove of said plurality of first grooves extending into a groove base of said second groove and another first groove of said plurality of first grooves extending into a groove base of said third groove, each first tab of said plurality or first tabs being aligned with and bent into a respective first groove of said plurality of first grooves, said second tab being aligned with and bent into said second groove, and said third tab being aligned with and bent into said third groove.

18. The connector module and panel assembly of claim 16 wherein at least said first wall comprises a first groove which protrudes into an outer surface of said first wall adjacent said base and extends in a circumferential direction relative to said first hole axis, and further wherein said panel is sandwiched between said conductive plate and a C-shaped clip which is force fit into said first groove.

* * * * *